US010486457B1

(12) United States Patent
Oas

(10) Patent No.: US 10,486,457 B1
(45) Date of Patent: Nov. 26, 2019

(54) COMBINATION SPINNER TOP HAVING MULTIPLE WRITING INSTRUMENTS

(71) Applicant: Daniel Oas, Irwindale, CA (US)

(72) Inventor: Daniel Oas, Irwindale, CA (US)

(73) Assignee: Calibre International, LLC, Irwindale, CA (US)

( * ) Notice: Subject to any disclaimer, the term of this patent is extended or adjusted under 35 U.S.C. 154(b) by 58 days.

(21) Appl. No.: 15/812,266

(22) Filed: Nov. 14, 2017

(51) Int. Cl.

| | |
|---|---|
| ***B43K 29/00*** | (2006.01) |
| ***A63H 1/00*** | (2019.01) |
| ***B43K 8/02*** | (2006.01) |
| ***B43K 23/08*** | (2006.01) |

(52) U.S. Cl.
CPC ..... *B43K 29/00* (2013.01); *A63H 1/00* (2013.01); *B43K 8/02* (2013.01); *B43K 23/08* (2013.01)

(58) Field of Classification Search
CPC ... A63H 1/00; A63H 1/16; A63H 1/22; B43K 29/00; B43K 8/02; B43K 23/08
USPC ..... 446/256, 264, 146; 401/131, 52
See application file for complete search history.

(56) References Cited

U.S. PATENT DOCUMENTS

| | | | | |
|---|---|---|---|---|
| 2,618,891 | A | 11/1952 | Pepsin | |
| 3,861,077 | A * | 1/1975 | Lindquist | A63H 1/16 33/27.11 |
| 4,986,685 | A | 1/1991 | Kiyokane | |
| 6,022,159 | A | 2/2000 | Kossnar et al. | |
| 6,190,076 | B1 | 2/2001 | Yeh | |
| D463,488 | S | 9/2002 | Kramer et al. | |
| 6,457,593 | B1 * | 10/2002 | Hsu | A47F 5/02 211/163 |
| D469,465 | S | 1/2003 | Chen | |
| D470,177 | S | 2/2003 | Chen | |
| 6,530,817 | B1 * | 3/2003 | Winslow | A63H 1/00 446/256 |
| D482,391 | S | 11/2003 | Hui | |
| D482,393 | S | 11/2003 | Hui | |
| 6,663,305 | B2 | 12/2003 | Poulos | |
| D504,910 | S | 5/2005 | Lee | |
| 7,361,075 | B1 * | 4/2008 | Krull | A63B 23/16 446/491 |
| 7,509,761 | B2 * | 3/2009 | Owusu-Atuahene | A63F 9/0415 40/503 |
| 7,819,600 | B2 | 10/2010 | LaBrasca | |
| D645,508 | S | 9/2011 | Goodelman | |
| 9,950,556 | B1 * | 4/2018 | Laemle | B43K 29/00 |
| 10,016,693 | B1 * | 7/2018 | Dowdy | A63H 33/003 |

FOREIGN PATENT DOCUMENTS

| | | | |
|---|---|---|---|
| DE | 29900634 | U1 | 4/1999 |
| KR | 2020110004606 | U | 5/2011 |

* cited by examiner

*Primary Examiner* — Nicholas J. Weiss
(74) *Attorney, Agent, or Firm* — Thomas I. Rozsa

(57) ABSTRACT

A combination spinning top including a multiplicity of petals removably retained at spaced apart locations on a circumferential end wall of a central round body to give the combination spinning top the appearance of a flower and to provide balance to enable the combination spinning top to spin on a tip for a longer period of time than it would spin without the petals. Each of the multiplicity of petals retain a writing instrument, the writing instrument also serving as an attaching arm to attach a respective petal to the central body of the spinner top.

21 Claims, 10 Drawing Sheets

COMBINATION SPINNER TOP HAVING MULTIPLE WRITING INSTRUMENTS

BACKGROUND OF THE INVENTION

1. Field of the Invention

The present invention relates to the field of writing instruments. Specifically, the present invention relates to highlighters that have multiple purposes.

2. Description of the Prior Art

The following 15 patents are the closest prior art known to the inventor:

1. U.S. Pat. No. 2,618,891 issued to Lawrence H. Pepsin on Nov. 25, 1952 for "Writing Top" (hereafter the "Pepsin Patent");
2. U.S. Pat. No. 4,986,685 issued to Jerrilyn C. Kiyokane on Jan. 22, 1991 for "Writing Instrument" (hereafter the "Kiyokane Patent");
3. U.S. Pat. No. 6,022,159 issued to Dennis Kossnar et al. on Feb. 8, 2000 for "Unique Dual Pen Holder" (hereafter the "Kossnar Patent");
4. U.S. Pat. No. 6,190,076 issued to Thomas Yeh on Feb. 20, 2001 for "Decorative Writing Implement" (hereafter the "Yeh Patent");
5. U.S. Pat. No. D463,488 issued to Jeffrey Kramer et al., on Sep. 24, 2002 for "Highlighter" (hereafter the "Kramer Patent");
6. U.S. Pat. No. D469,465 issued to Judy Chen on Jan. 28, 2003 for "Fluorescent Marker" (hereafter the "'465 Chen Design Patent");
7. U.S. Pat. No. D470,177 issued to Judy Chen on Feb. 11, 2003 for "Fluorescent Marker" (hereafter the "'177 Chen Design Patent");
8. U.S. Pat. No. D482,391 issued to Ve-chung Hui on Nov. 18, 2003 for "Star Shaped Marker Pen" (hereafter the "'391 Hui Design Patent");
9. U.S. Pat. No. D482,393 issued to Ve-chung Hui and on Nov. 18, 2003 for "Cat Face Marker Pen" (hereafter the "'393 Hui Design Patent");
10. U.S. Pat. No. 6,663,305 issued to Peter D. Poulos on Dec. 16, 2003 for "Multiple Marker Holder" (hereafter the "Poulos Patent");
11. U.S. Pat. No. D504,910 issued to Terry Lee on May 10, 2005 for "Crayon Wheel" (hereafter the "Lee Design Patent");
12. U.S. Pat. No. 7,819,600 issued to Claude LaBrasca on Oct. 26, 2010 for "Marker Pen Storage System" (hereafter the "LaBrasca Patent");
13. U.S. Pat. No. D645,508 issued to Stuart Goodelman on Sep. 20, 2011 for "Crayon Wheel" (hereafter the "Goodelman Design Patent");
14. German Patent No. DE29900634UI issued to Ulrich W. Breiter on May 12, 1999 for "Gyroscope and Package for the Gyroscope" (hereafter the "Breiter German Patent");
15. Korean Patent No. KR2020110004606U issued to Eun Sik Bae on May 11, 2011 for "Pen Plug" (hereafter the "Bae Korean Patent").

The Pepin Patent discloses a writing top. Specifically, the patent discloses a writing top for use in inscribing the path of a top when spinning. As set forth in the patent text, the object of the invention is: "First, to provide a writing top of this class which is provided with a ball point pen spinning bearing, which automatically writes on the surface on which the top is spinning, and traces a design which indicates the path of the top during spinning".

The Kiyokane Patent discloses a novelty item writing instrument which simulates the appearance of a food product such as a cookie or hamburger. The instrument is constructed of two mating parts. When the two parts are separated, the writing tip of the writing element is exposed for use. The Kiyokane Patent is only designed for one writing instrument.

The Kossnar Patent discloses a pen holder uniquely designed for holding two writing utensils in their individual capacity, separated from adjacent writing utensils, while providing protection for the marking tips of the writing utensils. The pen holder consists of a tube casing containing two tubes. Each tube is predisposed for releasably retaining a writing utensil, particularly a pen. There is a dividing wall which separates the tubes within the tube casing and the writing utensils.

The Yeh Patent discloses a decorative writing implement which includes an animal-shaped body having four limbs and a head. Each limb is detachable from the body and retains a pen therein. The Yeh Patent discloses pens or pencils that are removably affixed to a central base that can be removed, used and then replaced.

The Kramer Design Patent only protects the shape of the invention.

The '465 Chen Design Patent only protects the shape of the invention.

The '177 Chen Design Patent also protects the shape of the invention.

The '391 Hui Design Patent only protects the shape of the invention.

The '393 Hui Design Patent only protects the shape of the invention.

The Poulos Patent discloses a holder that is designed to hold within a single molded structure, up to four marking implements such as a carpenter's pencil or a lumber crayon. The marker holder, which is configured to resemble a Greek cross, consists of a vertical tube having a rectangular or circular cross-section, a right wall and a left wall. Respectively attached to the two walls, is a right horizontal tube and a left horizontal tube. Each tube includes a set of marker support tabs that grip and retain the carpenter's pencil and the lumber crayon.

The Poulos Patent has a means for holding up to four markers which include a flat carpenter's pencil and three lumber crayons. This patent has the concept of having the writing instruments within the central holding portion, not within the portion that is pulled out of the flower design.

The Lee Design Patent only protects the shape of the invention.

The LaBrasca Patent discloses a marker pen storage system consisting of a series of markers that are lined vertically next to one another and inserted into a base for storage. The patent further discloses walls that are lined between each of the housing portions where the vertically placed markers snap fit with a sound when placed inside the housing.

The Goodelman Design Patent only protects the shape of the invention.

The Breiter German Patent discloses a gyroscope with a conical oscillating body as well as packaging for the gyroscope.

The Bae Korean Patent discloses a pen holder for a vehicle divided into several parts in a radial elastic body.

None of the prior art patents disclose a base that spins with multiple highlighter ends that can be removed and used simultaneously. Thus, there is a need for the present invention and the present invention is an improvement over the prior art.

SUMMARY OF THE INVENTION

The present invention is a writing instrument with a base spinner having multiple writing ends that may be detached for use and then replaced back onto the base spinner.

It is an object of the present invention to have a center circular body with a tip so that if the tip is on a horizontal surface, a horizontal rotational force on the center circular body will cause it to spin like a top.

It is also an object of the present invention to have the entire device resemble a flower wherein each "petal" is either a writing instrument or retains a writing instrument. In this case, each "petal" is a different color which houses a different colored writing instrument.

It is an additional object of the present invention to have the writing instrument be a marker, crayon, a ballpoint pen, pencil, highlighter, or any other commonly used writing instrument.

It is a further object of the present invention to provide a multitude of colors for the writing instruments with each of the colors of a respective petal matching the color of the writing instrument retained by the petal.

It is a further object of the present invention to provide a multitude of colors for the writing instruments with each of the colors of the petal not having to match the color of the writing instrument.

It is still a further object of the present invention to provide a rotatable base having writing instruments that are press fit retained to the outer circumference of the base spinner.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF EMBODIMENTS OF THE PRESENT INVENTION

Figure 1:
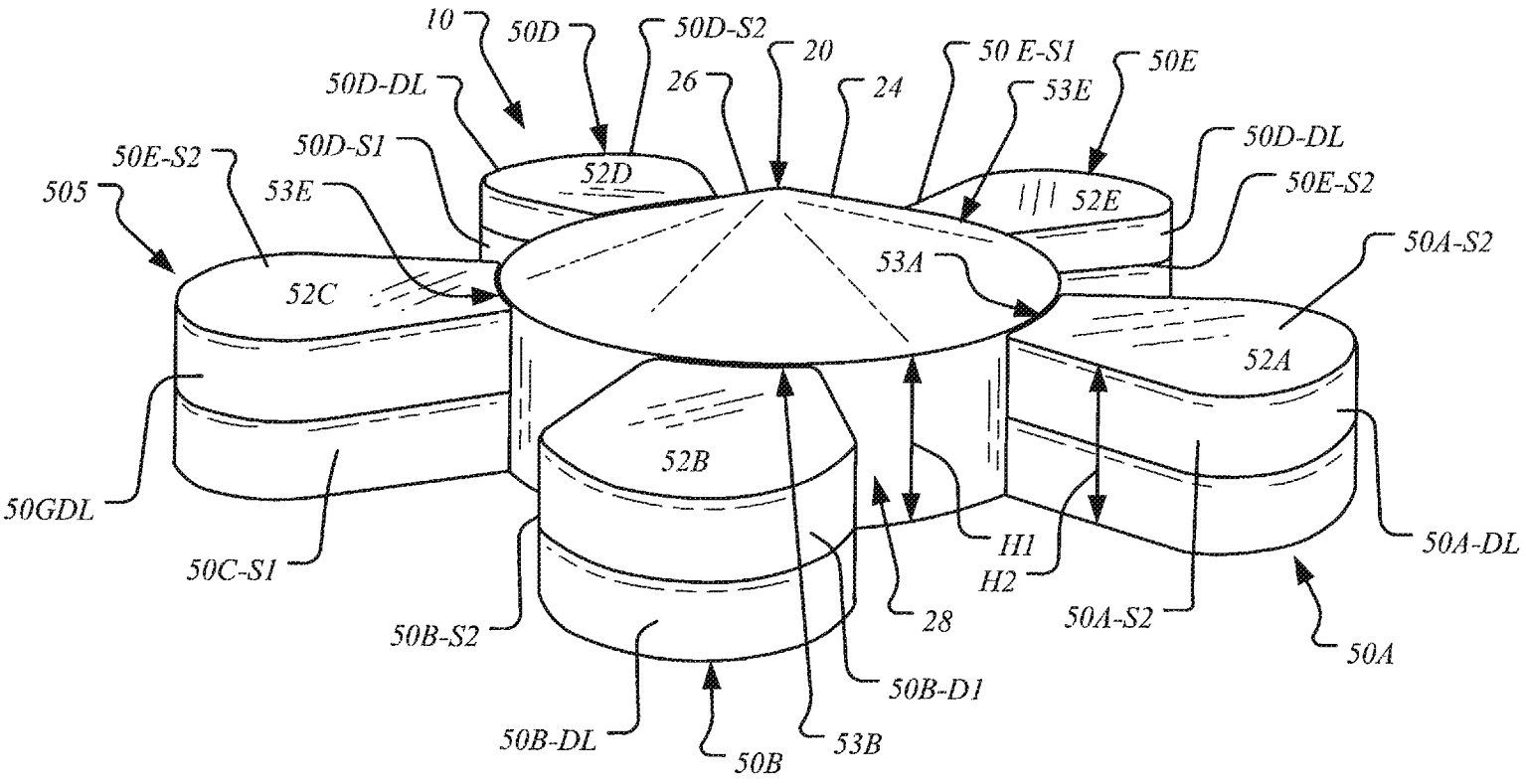
FIG. 1 is a top front side perspective view of the present invention combination spinner top in the shape of a flower with a multiplicity of petals with each respective petal retaining a writing instrument, the writing instrument also serving as an attaching arm to attach a respective petal to the central body of the spinner top.
Figure 2:
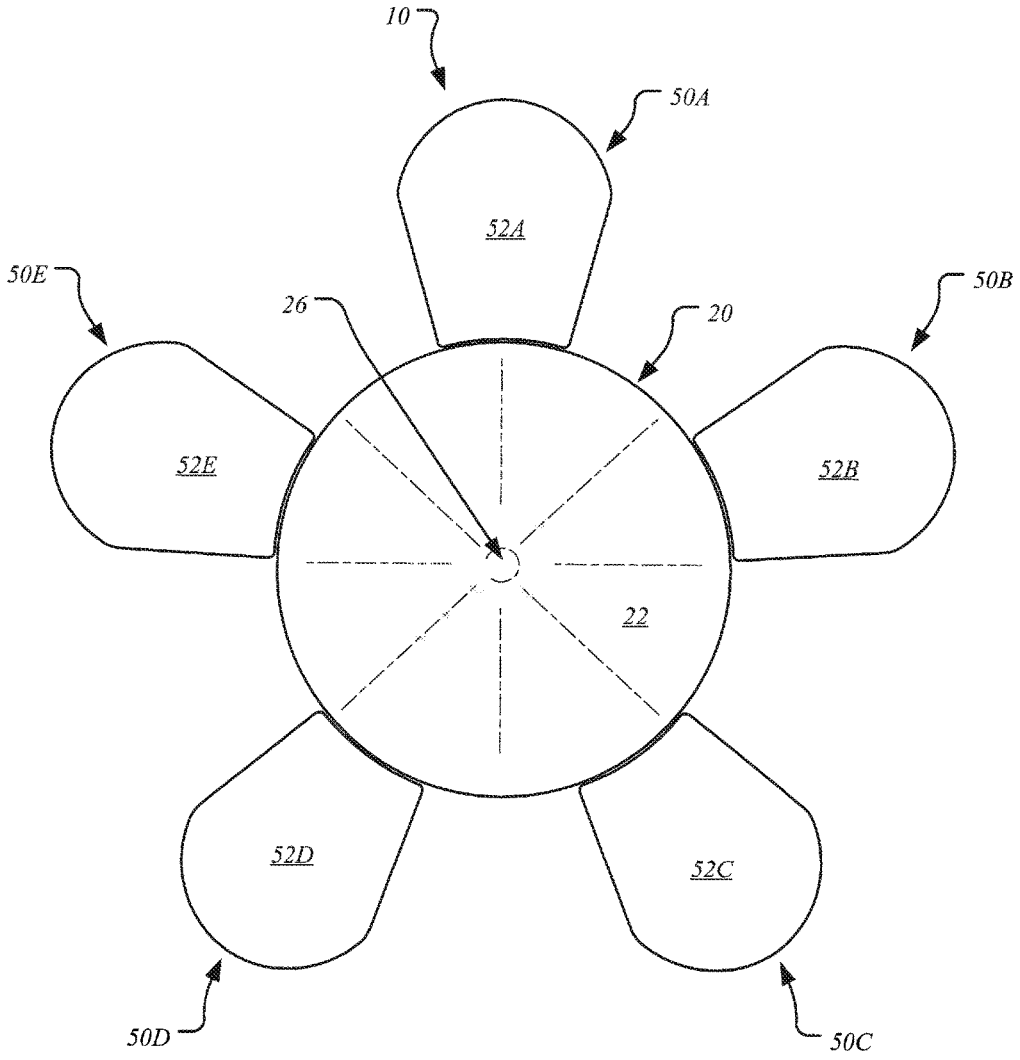
FIG. 2 is a top plan view of the present invention combination spinner top in the shape of a flower with a multiplicity of petals with each respective petal retaining a writing instrument, the writing instrument also serving as an attaching arm to attach a respective petal to the central body of the spinner top.
Figure 3:
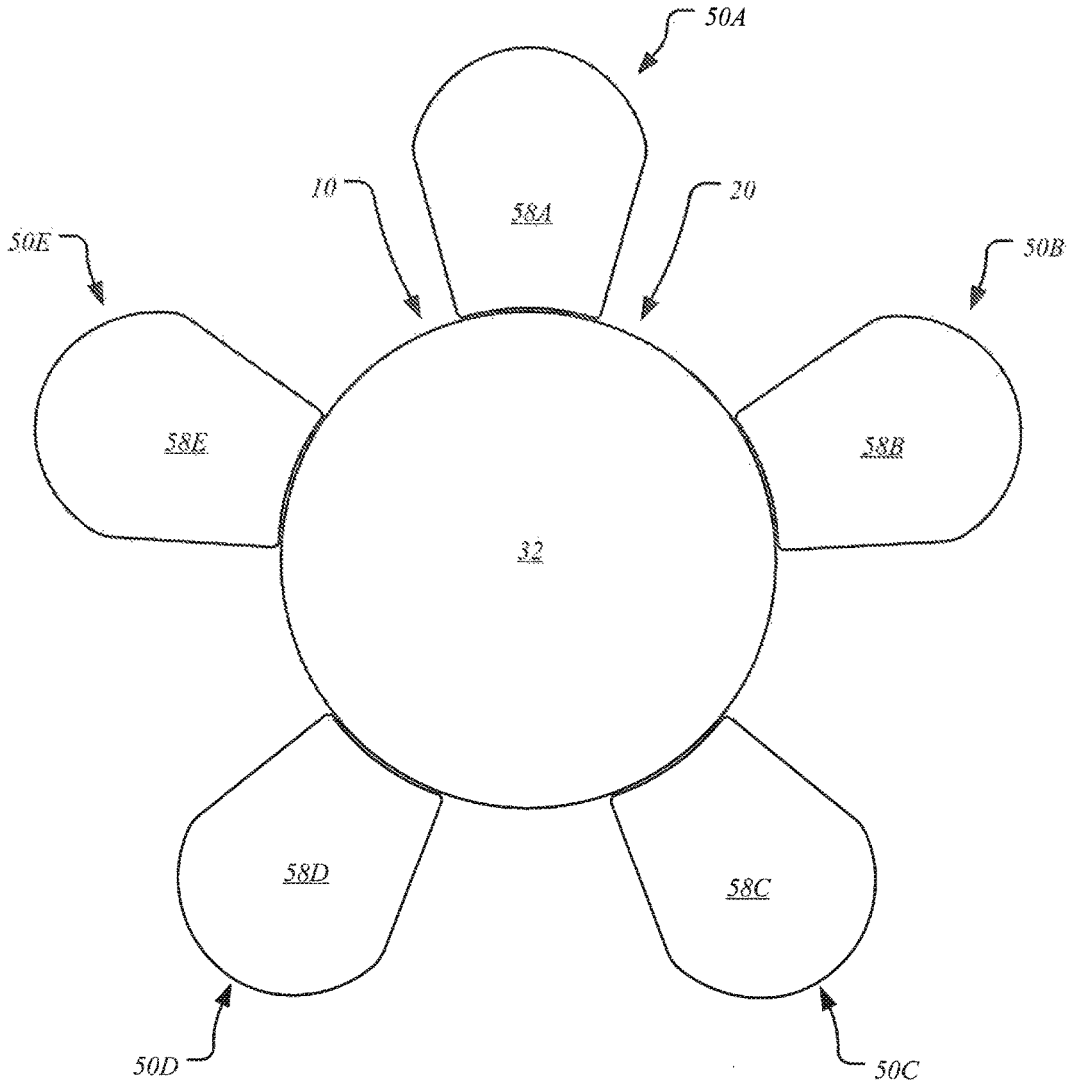
FIG. 3 is a bottom plan view of the present invention combination spinner top in the shape of a flower with a multiplicity of petals with each respective petal retaining a writing instrument, the writing instrument also serving as an attaching arm to attach a respective petal to the central body of the spinner top.
Figure 4:
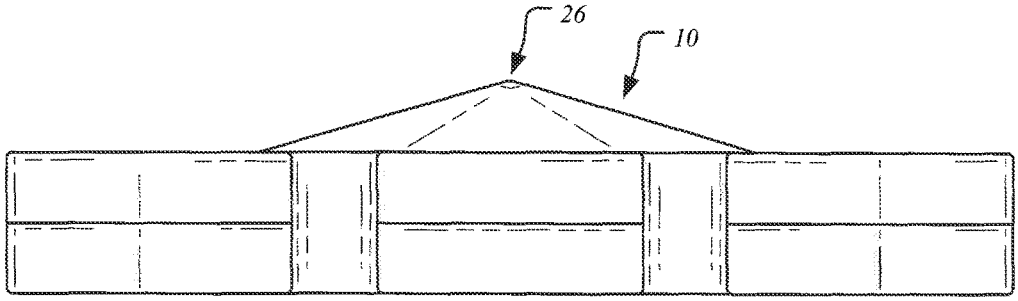
FIG. 4 is a front side view of the present invention combination spinner top in the shape of a flower with a multiplicity of petals with each respective petal retaining a writing instrument, the writing instrument also serving as an attaching arm to attach a respective petal to the central body of the spinner top.
Figure 5:
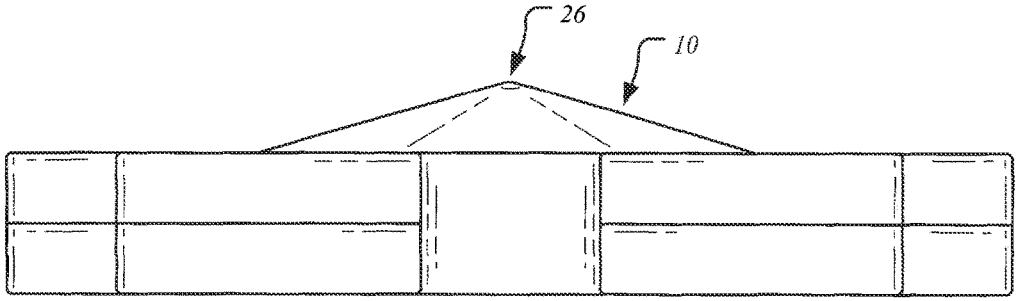
FIG. 5 is a rear side view of the present invention combination spinner top in the shape of a flower with a multiplicity of petals with each respective petal retaining a writing instrument, the writing instrument also serving as an attaching arm to attach a respective petal to the central body of the spinner top.
Figure 6:
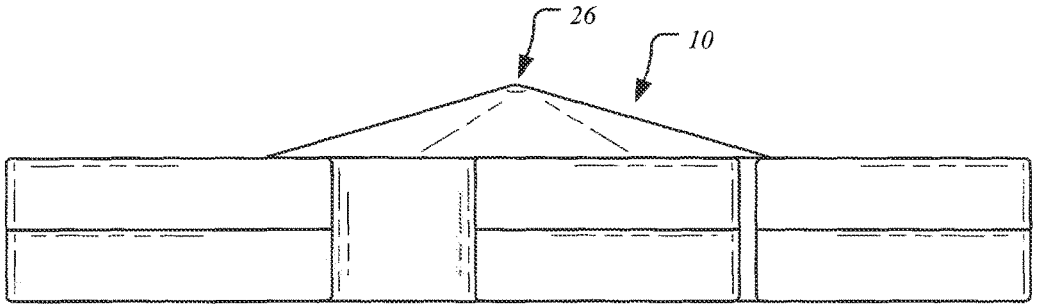
FIG. 6 is a right side view of the present invention combination spinner top in the shape of a flower with a multiplicity of petals with each respective petal retaining a writing instrument, the writing instrument also serving as an attaching arm to attach a respective petal to the central body of the spinner top.
Figure 7:
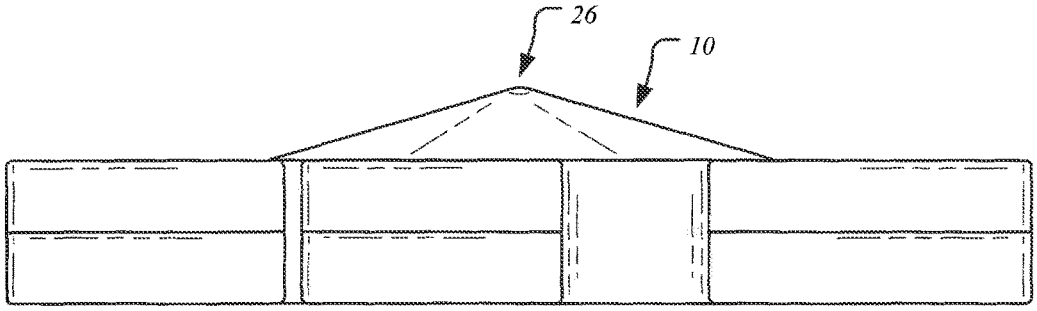
FIG. 7 is a left side view of the present invention combination spinner top in the shape of a flower with a multiplicity of petals with each respective petal retaining a writing instrument, the writing instrument also serving as an attaching arm to attach a respective petal to the central body of the spinner top.

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Referring to FIGS. 1 through 9, there is respectively illustrated a top front side perspective view, a top plan view, a bottom plan view, a front side view, a rear side view, a right side view, a left side view, a top perspective view and a bottom perspective view of the present invention combination spinner top in the shape of a flower with a multiplicity of petals with each respective petal retaining a writing instrument, the writing instrument also serving as an attaching arm to attach a respective petal to the body of the spinner top.

Referring to FIGS. 1 through 9, there is illustrated the spinner top in the shape of a flower 10 in a stationary condition. The invention includes a central circular body 20 bounded by a circumferential end wall 28 which extends from a top surface 22 to a bottom surface 32. The top surface 22 extends from its circumferential edge 24 at a an evenly sloped section 25 terminating in a central tip 26. The bottom surface 32 is flat and lies flat against a horizontal surface. When turned upside down so that top central tip 26 touches a flat surface, a rotational twist force in a horizontal direction causes the central circular body 20 to spin like a top with the top central tip 26 serving as the axis of rotation.

The combination spinning top 10 includes a multiplicity of petals removably retained at spaced apart locations on the circumferential end wall 28 to give the combination spinning top 10 the appearance of flower and to provide balance to enable the combination spinning top 10 to spin on tip 26 for a longer period of time than it would spin without the petals. It will be appreciated that any multiplicity of petals is within the spirit and scope of the present invention. A preferred embodiment is to have five (5) petals as illustrated in FIGS. 1 through 10. Each of the petals will now be described with reference to previously described FIGS. 1 through 9, FIG. 10 which is a top exploded view of the present invention combination spinner top in the shape of a flower with a multiplicity of petals with each respective petal retaining a writing instrument, the writing instrument also serving as an attaching arm to attach a respective petal to the central body of the spinner top, illustrating each petal retaining a writing instrument removed from the central body of the spinner top, and FIG. 12 which a cross-sectional view taken along line A-A of FIG. 8.

The front or first petal 50A has a transverse arcuate distal wall 50A-DL with oppositely disposed transverse sloping side transverse walls 50A-S1 and 50A-S2 which end on opposite sides of a curved transverse interior wall 54A having an interior curvature 53A which is the same as the curvature of transverse wall 28, also referred to as circumferential end wall. Front petal 50A has a bottom wall 58A and a top wall 52A. The height of each of the transverse walls 50A-DL, 50A-S1, 50A-S2 and 54A from top wall 52A to bottom wall 58A is "H2". The height of transverse wall 28, also referred to as circumferential end wall 28 from top edge 24 to bottom wall 32 is "H1" and the height of all of the transverse walls of first petal 50A is "H2". The height "H1" and "H2" are the same so that when transverse interior wall 54A is pressed against transverse wall 28, the two surfaces are aligned and bottom wall 32 of central circular body 20 and the bottom wall 58A of first petal 50A are aligned. Transverse interior wall 54A includes a petal retaining member 57A which is a slotted interior chamber to retain a base 56A of a writing tip 55A of a first writing instrument 50A-W. Aligned with the first writing instrument 50A-W is a writing instrument retaining member 20A extending from transverse wall 28 into the central circular body 20. The writing instrument retaining member 20A is sized too press fit retain writing instrument 50A-W of first pedal 50A so that the writing tip 55A is concealed within central circular body 20. When it is desired to use the first writing instrument 50A-W, first petal 50A is pulled radially outward to release the press-fit retention of the writing instrument 50A-W to expose writing tip 55A. The petal 50A is gripped so that writing tip 55A is used. The writing instrument 50A-W is selected from the group consisting of a marker, a highlighter, a crayon, a pen and a pencil.

If the first petal 50A is at a 12 o'clock position of the central circular body 20, the remaining four petal are equally spaced apart on circumferential wall 28 of central circular body 20, which by way of example, second petal 50C is at 12.5 o'clock, third petal 50C is at 22.5 o'clock, fourth petal 50D is at 37.5 o'clock and fifth petal 50E is at 47.5 o'clock.

The second petal 50B has a transverse arcuate distal wall 50B-DL with oppositely disposed transverse sloping side transverse walls 50B-S1 and 50B-S2 which end on opposite sides of a curved transverse interior wall 54B having an interior curvature 53B which is the same as the curvature of transverse wall 58. Second petal 50B has a bottom wall 58B and a top wall 52B. The height of each of the transverse walls 50B-DL, 50B-S1, 50B-S2 and 54B from top wall 52B to bottom wall 58B is "H2". The height of transverse wall 28 from top edge 24 to bottom wall 32 is "H1" and the height of all of the transverse walls of second petal 50B is "H2". The height "H1" and "H2" are the same so that when transverse interior wall 54B is pressed against transverse wall 58, the two surfaces are aligned and bottom wall 32 of central circular body 20 and the bottom wall 58B of second petal 50B are aligned. Transverse interior wall 54B includes a petal retaining member 57B which is a slotted interior chamber to retain a base 56B of a writing tip 55B of a second writing instrument 50B-W aligned with the second writing instrument 50B-W is a writing instrument retaining member 20B extending from transverse wall 58 into the central circular body 20. The writing instrument retaining member 20B is sized to press fit retain writing instrument 50B-W of second petal 50B so that the writing tip 55B is concealed within central circular body 20. When it is desired to use the second writing instrument 50B-W, second petal 50B is pulled radially outward to release the press-fit retention of the writing instrument 50B-W to expose writing tip 55B. The petal 50B is gripped so that writing tip 55B is used. The writing instrument 50B-W is selected from the group consisting of a marker, a highlighter, a pen and a pencil.

The third petal 50C has a transverse arcuate distal wall 50C-DL with oppositely disposed transverse sloping side transverse walls 50C-S1 and 50C-S2 which end on opposite sides of a curved transverse interior wall 54C having an interior curvature 53C which is the same as the curvature of transverse wall 28. Third petal 50C has a bottom wall 58C and a top wall 52C. The height of each of the transverse walls 50C-DL, 50C-S1, 50C-S2 and 54C from top wall 52C to bottom wall 58C is "H2". The height of transverse wall 28 from top edge 24 to bottom wall 32 is "H1" and the height of all of the transverse walls of third petal 50C is "H2". The height "H1" and "H2" are the same so that when transverse interior wall 54C is pressed against transverse wall 28, the two surfaces are aligned and bottom wall 32 of central circular body 20 and the bottom wall 58C of second petal 50C are aligned. Transverse interior wall 54C includes a petal retaining member 57C which is a slotted interior chamber to retain a base 56C of a writing tip 55C of a second writing instrument 50C-W. Aligned with the third writing instrument 50C-W is a writing instrument retaining member 20C extending from transverse wall 58 into the central circular body 20. The writing instrument retaining member 20C is sized to press fit retain writing instrument 50C-W of second petal 50C so that the writing tip 55C is concealed within central circular body 20. When it is desired to use the third writing instrument 50C-W, third petal 50C is pulled radially outward to release the press-fit retention of the writing instrument 50C-W to expose writing tip 55C. The petal 50C is gripped so that writing tip 55C is used. The writing instrument 50C-W is selected from the group consisting of a marker, a highlighter, a crayon, a pen and a pencil.

The fourth petal 50D has a transverse arcuate distal wall 50D-DL with oppositely disposed transverse sloping side transverse walls 50D-S1 and 50D-S2 which end on opposite sides of a curved transverse interior wall 54D having an interior curvature 53D which is the same as the curvature of transverse wall 28. Fourth petal 50D has a bottom wall 58D and a top wall 52D. The height of each of the transverse walls 50D-DL, 50D-S1, 50D-S2 and 54D from top wall 52D on bottom wall 58D is "H2". The height of transverse wall 28 from top edge 24 to bottom wall 32 is "H1" and the height of all of the transverse walls of fourth petal 50C is "H2". The height "H1" and "H2" are the same so that when transverse interior wall 54D is pressed against transverse wall 28, the two surfaces are aligned and bottom wall 32 of central circular body 20 and the bottom wall 58D of fourth petal 50D are aligned. Transverse interior wall 54D includes a petal retaining member 57D which is a slotted interior chamber to retain a base 56D of a writing tip 55D of a fourth writing instrument 50D-W. Aligned with the fourth writing instrument 50D-W is a writing instrument retaining member 20D extending from transverse wall 28 into the central circular body 20. The writing instrument retaining member 20D is sized to press fit retain writing instrument 50D-W of second petal 50D so that the writing tip 55D is concealed within central circular body 20. When it is desired to use the fourth writing instrument 50D-W, fourth petal 50D is pulled radially outward to release the press-fit retention of the writing instrument 50D-W to expose writing tip 55D. The petal 50D is gripped so that writing tip 55D is used. The writing instrument 50D-W is selected from the group consisting of a marker, a highlighter, a pen and a pencil.

The fifth petal 50E has a transverse arcuate distal wall 50E-DL with oppositely disposed transverse sloping side transverse walls 50E-S1 and 50E-S2 which end on opposite sides of a curved transverse interior wall 54E having an interior curvature 53E which is the same as the curvature of transverse wall 28. Fifth petal 50E has a bottom wall 58E and a top wall 52E. The height of each of the transverse walls 50E-DL, 50E-S1, 50E-S2 and 54E from top wall 52E of bottom wall 58E is "H2". The height of transverse wall 28 from top edge 24 to bottom wall 32 is "H1" and the height of all of the transverse walls of fifth petal 50E is "H2". The height "H1" and "H2" are the same so that when transverse interior wall 54E is pressed against transverse wall 28, the two surfaces are aligned and bottom wall 32 of central circular body 20 and the bottom wall 58E of fifth petal 50E are aligned. Transverse interior wall 54D includes a petal retaining member 57D which is a slotted interior chamber to retain a base 56D of a writing tip 55D of a fifth writing instrument 50E-W. Aligned with the fifth writing instrument 50E-W is a writing instrument retaining member 20D extending from transverse wall 58 into the central circular body 20. The writing instrument retaining member 20E is sized to press fit retain writing instrument 50E-W of second petal 50E so that the writing tip 55E is concealed within central circular body 20. When it is desired to use the fifth writing instrument 50E-W, fourth petal 50E is pulled radially outward to release the press-fit retention of the writing instrument 50E-W to expose writing tip 55E. The petal 50D is gripped so that writing tip 55D is used. The writing instrument 50E-W is selected from the group consisting of a marker, a highlighter, a pen and a pencil.

In summary, the present invention combination spinner top 10 rotates about when spinning on top central tip 26. Combination spinner top 10 also has a vertical circumferential end wall 28 that abuts each of the five (5) petals which respectively contain writing instruments, It is also within the spirit and scope of the present invention to refer to a combination petal and the writing instrument it retains as a writing instrument. Each of the writing instruments 50A, 50B, 50C 50D, and 50E are press fit retained to the central circular base 20.

Combination spinner top 10 has a bottom surface 32 that can be used when the present invention is not being rotated to keep the combination spinner top 10 stationary while any or all of writing instruments 50A, 50B, 50C, 50D, and 50E are detached and being used.

Figure 10:
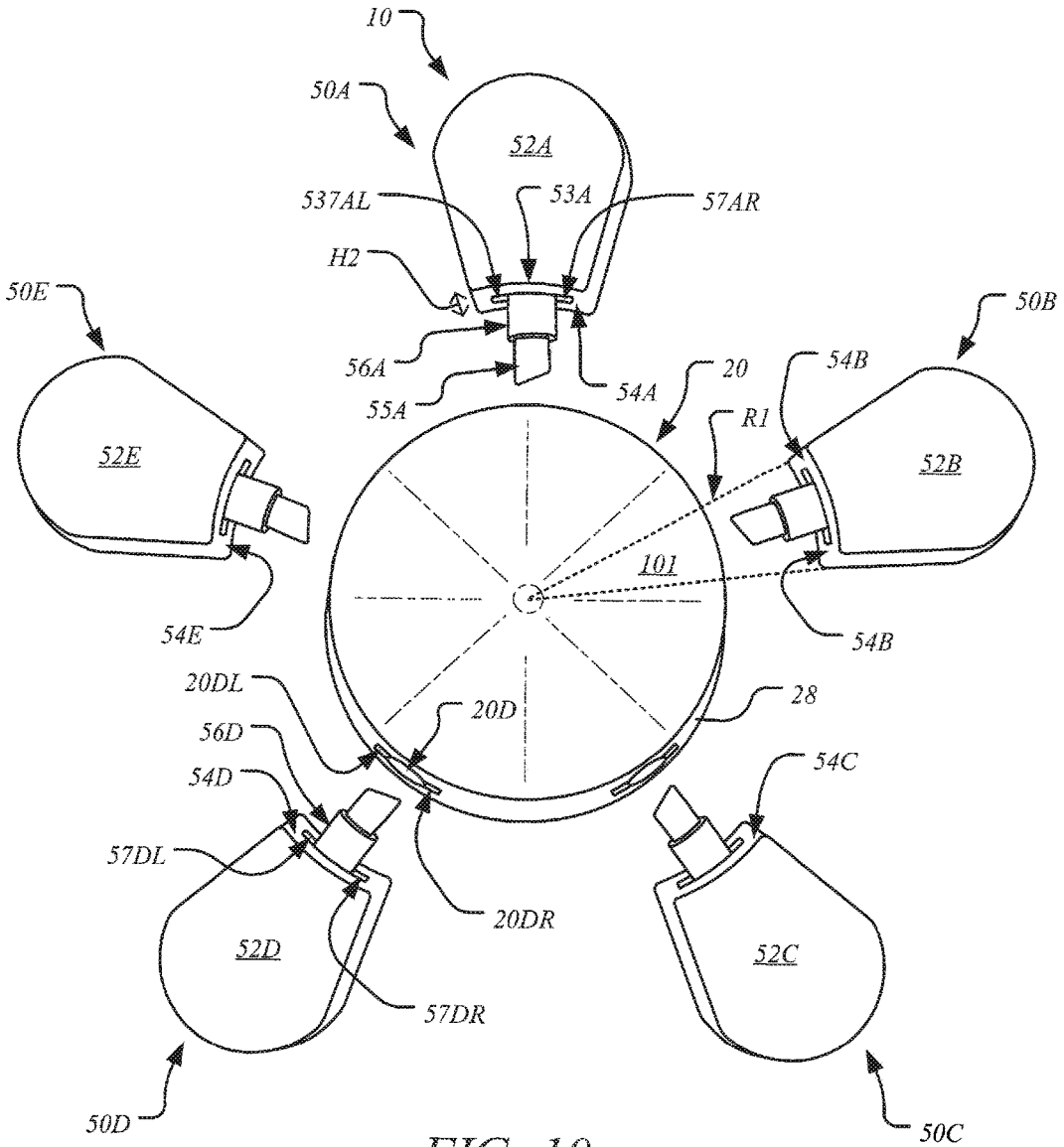
FIG. 10 is a top exploded view of the present invention combination spinner top in the shape of a flower with a multiplicity of petals with each respective petal retaining a writing instrument, the writing instrument also serving as an attaching arm to attach a respective petal to the central body of the spinner top, illustrating each petal retaining a writing instrument removed from the central body of the spinner top.

Referring to FIG. 1 and FIG. 10, there is illustrated the present invention combination spinner top 10 having a vertical circumferential end wall 28 with a height of that is approximately equal to the vertical height H2 "H2" of writing instrument front surface 54A. As the components of each of the writing instruments are explained below it should be understood that there are multiple instruments (50A, 50B, 50C, 50D, and 50E) with each of which has identical elements. Thus, definitions explaining to parts 50A, 50B, or 50D apply to all writing instruments (50A, 50B, 50C, 50D, and 50E).

Writing instrument front surface 54A has a curved front surface with a degree of curvature D1 (illustrated on writing instrument 50B) approximately equal to the curvature of vertical circumferential end wall 28 to form a seamless connection to central circular base 20 when writing instrument 50A is press fit retained to central circular base 20. Writing instrument 50A has a writing instrument tip 55A that extends perpendicularly away from writing instrument base 56A. Both writing instrument base 56A and writing instrument tip 55A also extend perpendicularly away from writing instrument front surface 54A. On either side of writing instrument base 56A is a front surface left protrusion 57AL and a front surface right protrusion 57AR.

Referring to FIG. 10, there is illustrated a central opening 20D that is shaped and sized to accept writing instrument base 56D. On opposite sides of illustrated central opening 20D are left groove 20DL and right groove 20DR. To retain writing instrument 50D to central circular base 20, writing instrument base 56D is placed inside of central opening 20D. The press fit retention for all the writing instruments (50A, 50B, 50C, 50D, and 50E) is the same.

Referring to FIG. 10, there is illustrated a front surface left protrusion 57DL and a front surface right protrusion 57DR that are accepted by left groove 20DL and right groove 20DR to form a press fit connection and retain writing instrument 50D to central circular base 20. All the writing instruments (50A, 50B, 50C, 50D, and 50E) attach and are retained in the same manner as described for writing instrument 50D.

Writing instruments may be inserted and press fit retained in two ways. First the writing instruments (50A, 50B, 50C, 50D, and 50E) may be inserted when writing instrument top surface (52A, 52B, 52C, 52D, and 52E) is facing upward. Secondly when each writing instrument is rotated 180 degrees with each top surface facing directly downwards and writing instrument bottom surfaces (58A, 58B, 58C, 58D, and 58E) facing upwards, the writing instruments may be inserted and accepted by central circular base 20.

The degree of curvature is measured by the equation $D=180A/\Pi \times r$, where r=radius of curvature and D=the degree of curvature. Referring to FIG. 10, the degree of curvature is labeled D1 and the radius of curvature is labeled R1. The radius of curvature and the degree of curvature of vertical circumferential end wall 28 is approximately equal to the radius of curvature and the degree of curvature for writing instrument front surfaces 54A, 54B, 54C, 54D, and 54E to allow each of the writing instruments 50A, 50B, 50C, 50D, and 50E to abut seamlessly to central circular base 20 when each of the writing instruments (50A, 50B, 50C, 50D, and 50E) are press fit retained to central circular base 20.

Figure 11:
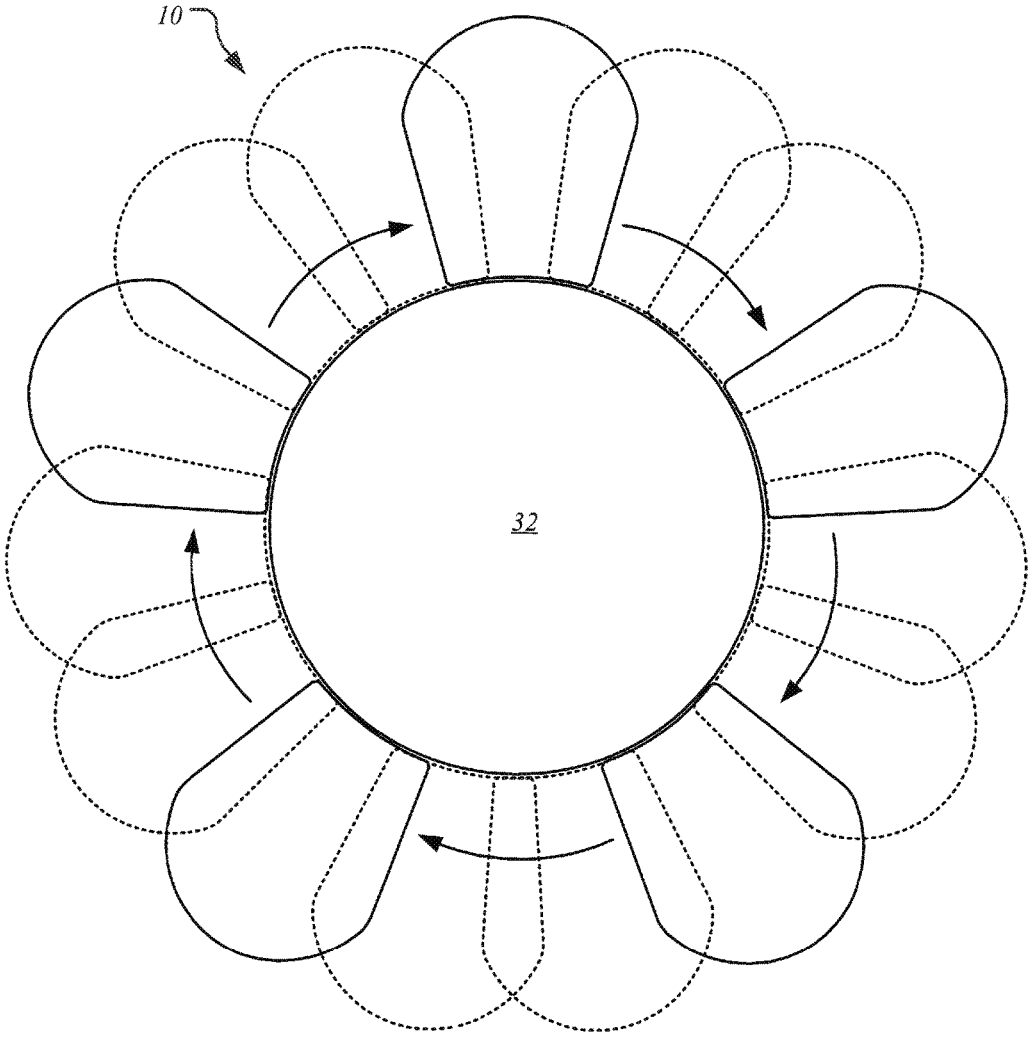
FIG. 11 is a bottom plan view of the present invention combination spinner top in the shape of a flower with a multiplicity of petals with each respective petal retaining a writing instrument, the writing instrument also serving as an attaching arm to attach a respective petal to the body of the spinner top, illustrating the top spinning.

Referring to FIG. 11, there is illustrated the present invention combination spinner top 10 with bottom surface 32 facing up and the combination spinner top 10 in motion and spinning in the clockwise direction on top central tip 26 (illustrated in FIG. 1).

Figure 8:
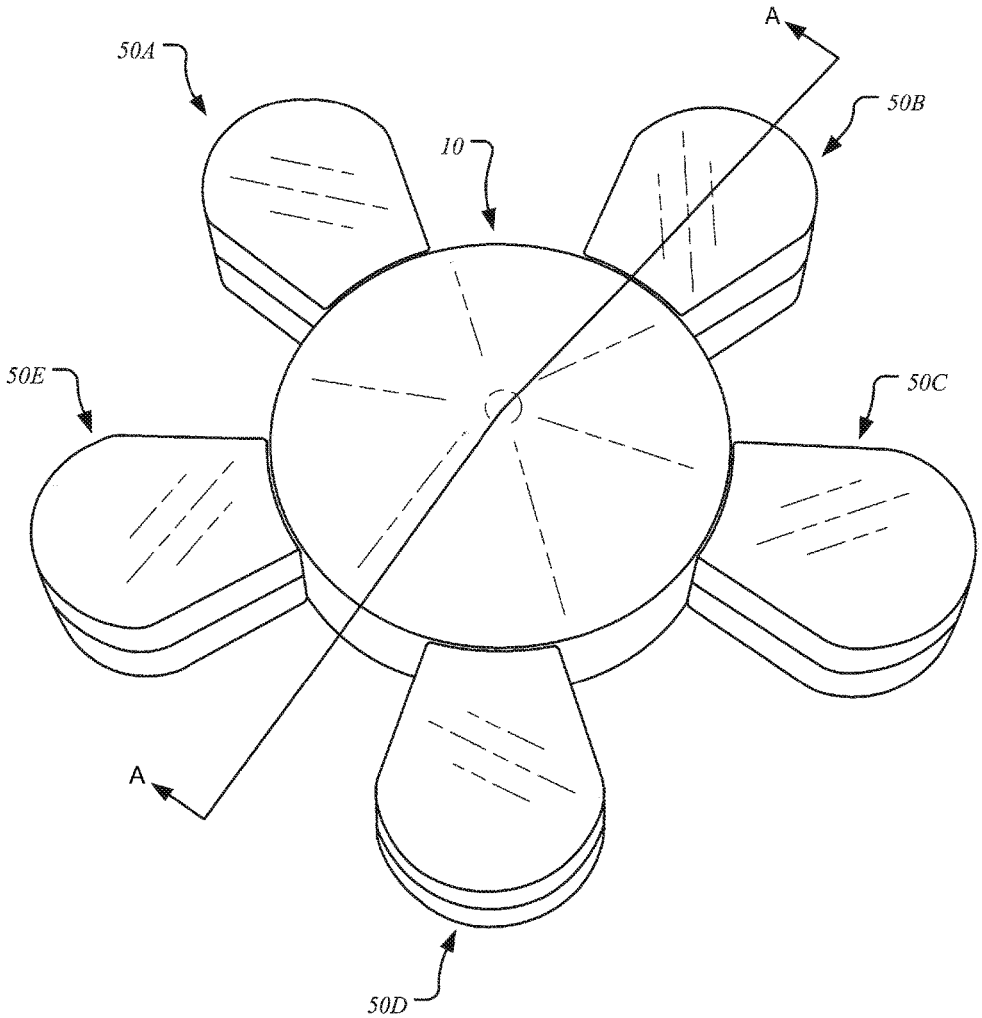
FIG. 8 is a top perspective view of the present invention combination spinner top in the shape of a flower with a multiplicity of petals with each respective petal retaining a writing instrument, the writing instrument also serving as an attaching arm to attach a respective petal to the central body of the spinner top.
Figure 9:
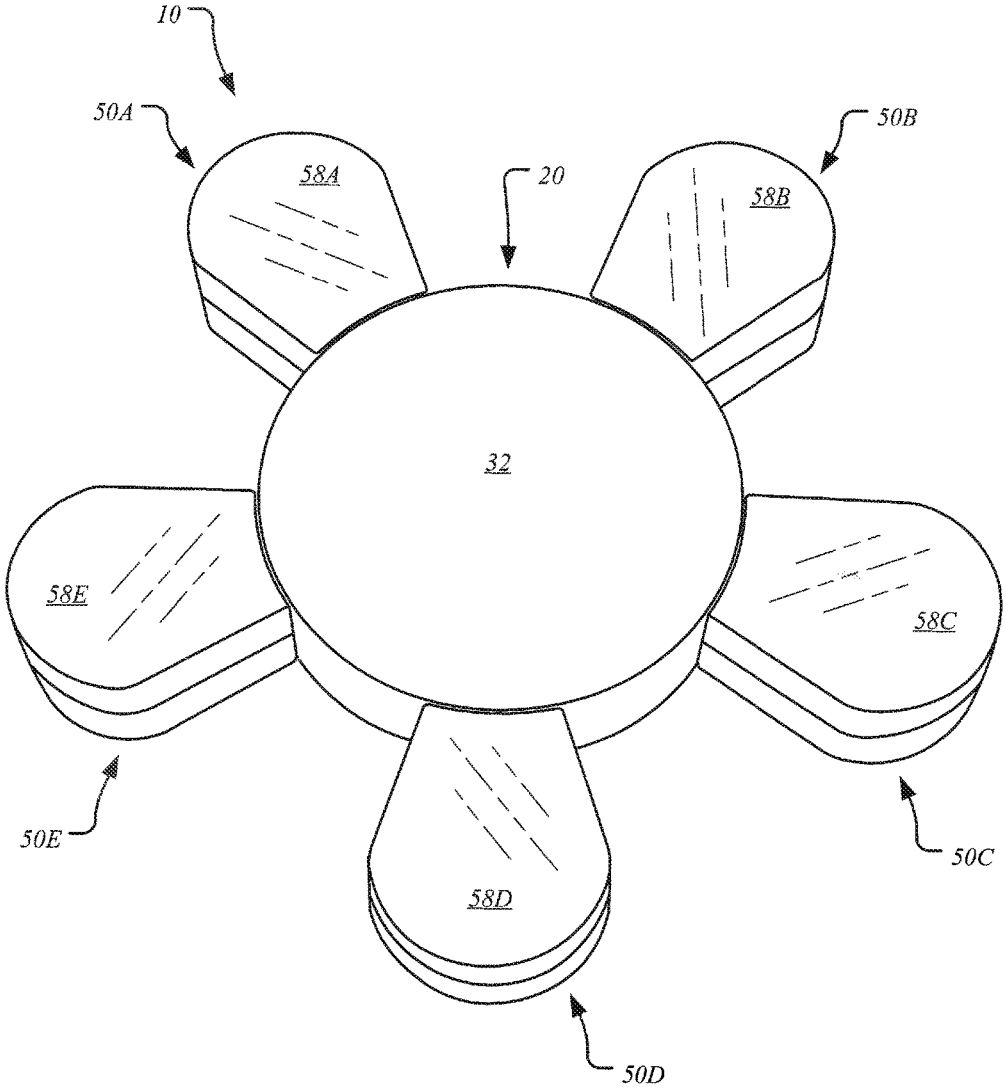
FIG. 9 is a bottom perspective view of the present invention combination spinner top in the shape of a flower with a multiplicity of petals with each respective petal retaining a writing instrument, the writing instrument also serving as an attaching arm to attach a respective petal to the central body of the spinner top.
Figure 12:
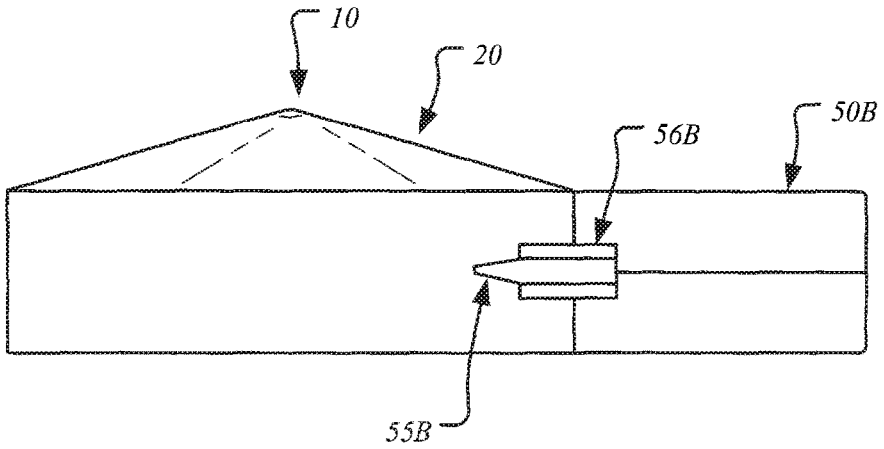
FIG. 12 is a cross-sectional view taken along line A-A of FIG. 8.

Referring to FIG. 12, there is illustrated a cross sectional view of the combination spinner top 10 taken along Line A-A illustrated in FIG. 8. Writing instrument 50B is shown removably affixed to central circular base 20. This cross section also illustrates writing instrument 50B having writing instrument base 56B and writing instrument tip 55B press fit retained within central circular base 20.

It is within the spirit and scope of this invention for there to be a different number of writing instruments other than five (5) as illustrated in the Figures extending from a central circular base that rotates. The diameter of the central circular base and the size of each of the writing instruments could also be larger or smaller than that which is disclosed above. Similarly, the press fit connection between the base and each writing instrument could also be achieved by tongue and grooves, male and female connections, ball and socket connections, or other commonly used removably affixing means.

Of course the present invention is not intended to be restricted to any particular form or arrangement, or any specific embodiment, or any specific use, disclosed herein, since the same may be modified in various particulars or relations without departing from the spirit or scope of the claimed invention herein above shown and described of which the apparatus or method shown is intended only for illustration and disclosure of an operative embodiment and not to show all of the various forms or modifications in which this invention might be embodied or operated.

What is claimed is:

1. An apparatus comprising:

a. a central circular body bounded by a circumferential transverse end wall having a first given height which extends from a circumferential edge of the central circular body top surface to a flat bottom surface, the top surface extends from its circumferential edge at an evenly upwardly sloped section terminating in a top central tip;

b. a multiplicity of petals removably press fit retained at spaced apart locations on the circumferential end wall to give a combination of the central circular body and the multiplicity of petals the appearance of a flower, each of the respective multiplicity of petals retaining a writing instrument;

c. each respective one of the multiplicity of petals having a transverse arcuate distal wall with oppositely disposed sidewalls ending on opposite sides of a curved transverse interior wall having an interior curvature which is the same as an exterior curvature of said circumferential transverse end wall, each of the multiplicity of petals having a second given height extending from a circumference of a top surface to a flat bottom surface, the first given height equal to the second given height, the curved transverse interior wall of each respective petal including a petal retaining member and a writing instrument attached to the curved transverse interior wall, the central circular body having a respective petal receiving member to removably press fit retain a respective petal retaining member and conceal the respective writing instrument; and d. a combination of the central circular body and the multiplicity of spaced apart petals provide operation as a spinning top spinning about the top central tip when it is placed on a horizontal surface and a horizontal force is applied to the central circular body, and a combination of the multiplicity of petals serve to balance the top central tip and prolong the spinning, and when stationary, each of the respective multiplicity of petal functioning as a writing instrument when a respective petal is pulled out of the central circular body with the petal gripped and the writing tip used to write.

2. The apparatus in accordance with claim 1, further comprising: each of the multiplicity of petals is a selected color.

3. The apparatus in accordance with claim 1, further comprising: each of the multiplicity of petals retains a writing instrument having a color the same as a color of the petal retaining the writing instrument.

4. The apparatus in accordance with claim 1, further comprising: each of the multiplicity of petals retains a writing instrument having a different color from a color of the petal retaining the writing instrument.

5. The apparatus in accordance with claim 1, further comprising each respective writing instrument is selected from the group consisting of a highlighter, a marker, a crayon, a pen and a pencil.

6. An apparatus comprising:

a. a central circular base having a top surface, a bottom surface, a vertical circumferential end wall, and at least one writing instrument that is removably affixed to said central circular base;

b. said top surface extending from a top circumferential edge to a top central tip;

c. said at least one writing instrument having a writing instrument front surface, a writing instrument top surface, a writing instrument bottom surface, a writing instrument base, a writing instrument tip, a front surface left protrusion, and a front surface right protrusion;

d. said circular base having at least one central opening, at least one left groove, and at least one right groove;

e. said writing instrument front surface having a degree of curvature matching a degree of curvature of said vertical circumferential end wall;

f. said at least one writing instrument is removably retained to said central circular base when said writing instrument base is inserted into said at least one central opening and said front surface left protrusion and said front surface right protrusion are respectively inserted into said at least one left groove and said at least one right groove; and g. whereby, when said top central tip is placed on a flat horizontal surface and a horizontal force is applied to said central circular base, the apparatus spins like a top.

7. The apparatus in accordance with claim 6, further comprising: said vertical circumferential end wall has a height H1 that is equal to a height H2 of said writing instrument front surface.

8. The apparatus in accordance with claim 6, further comprising: said central circumferential base bottom surface and said writing instrument bottom surface are aligned flat surfaces.

9. The apparatus in accordance with claim 6, further comprising: the at least one writing instrument is selected from the group consisting of marker, a crayon, a ballpoint pen, a pencil, and a highlighter.

10. An apparatus comprising:

a. a central body bounded by a circumferential end wall which extends from a circumferential top edge of the central body to a circumferential bottom edge of the central body, the circumferential bottom edge surrounds a flat bottom surface of a flat bottom wall of the central body, the circumferential top edge surrounds a top surface which extends at an even upwardly extending slope beginning at the circumferential top edge and terminating at a top central tip, a distance from said flat bottom surface to said to central tip greater than a distance from said flat bottom surface to sad circumferential top edge;

b. five petals removably press fit retained at spaced apart locations on the circumferential end wall to give the central body and the five petals the appearance of a flower, each of the respective five petals retaining a writing instrument;

c. a first petal having a transverse arcuate distal wall with oppositely disposed transverse side walls which extend from opposite sides of the transverse arcuate distal wall and end at spaced apart locations on a curved interior wall of the first petal, the transverse arcuate distal wall, the oppositely disposed sidewalls and the curved interior wall having adjoining top ends and adjoining bottom end, the adjoining top ends surrounding a flat top surface, the adjoining bottom ends surrounding a flat bottom surface, a distance from the flat bottom surface to the flat top surface of the first petal being the same as the distance from the flat bottom surface of the central body to the circumferential top edge of the central body, a curvature of the curved interior wall of the first petal being equal to an exterior curvature of said circumferential end wall of said central body, the interior curved wall of the first petal including a first petal retaining member, a base of a first writing instrument attached to the interior curved wall, the base of the first writing instrument retaining a first writing instrument tip, the transverse end wall of the central body including a combined first writing instrument receiving member and first petal retaining member which is an aligned opening extending from the circumferential end wall into an interior of the central body to removably press fit retain the first petal and conceal the first writing instrument tip;

d. a second petal having a transverse arcuate distal wall with oppositely disposed transverse side walls which extend from opposite sides of the transverse arcuate distal wall and end at spaced apart locations on a curved interior wall of the second petal, the transverse arcuate distal wall, the oppositely disposed sidewalls and the curved interior wall having adjoining top ends and adjoining bottom ends, the adjoining top ends surrounding a flat top surface, the adjoining bottom ends surrounding a flat bottom surface, a distance from the flat bottom surface to the flat top surface of the second petal being the same as the distance from the flat bottom surface of the central body to the circumferential top edge of the central body, a curvature of the curved interior wall of the second petal being equal to an exterior curvature of said circumferential end wall of said central body, the interior curved wall of the second petal including a second petal retaining member, a base of a second writing instrument attached to the interior curved wall, the base of the second writing instrument retaining a second writing instrument tip, the transverse end wall of the central body including a combined second writing instrument receiving member and second petal retaining member which is an aligned opening extending from the circumferential end wall into an interior of the central body to removably press fit retain the second petal and conceal the second writing instrument tip;

e. a third petal having a transverse arcuate distal wall with oppositely disposed transverse side walls which extend from opposite sides of the transverse arcuate distal wall and end at spaced apart locations on a curved interior wall of the third petal, the transverse arcuate distal wall, the oppositely disposed sidewalls and the curved interior wall having adjoining top ends and adjoining bottom ends, the adjoining top ends surrounding a flat top surface, the adjoining bottom ends surrounding a flat bottom surface, a distance from the flat bottom surface to the flat top surface of the third petal being the same as the distance from the flat bottom surface of the central body to the circumferential top edge of the central body, a curvature of the curved interior wall of the third petal being equal to an exterior curvature of said circumferential end wall of said central body, the interior curved wall of the third petal including a third petal retaining member, a base of a third writing instrument attached to the interior curved wall, the base of the third writing instrument retaining a third writing instrument tip, the transverse end wall of the central body including a combined third writing instrument receiving member and third petal retaining member which is an aligned opening extending from the circumferential end wall into an interior of the central body to removably press fit retain the third petal and conceal the third writing instrument tip;

f. a fourth petal having a transverse arcuate distal wall with oppositely disposed transverse side walls which extend from opposite sides of the transverse arcuate distal wall and end at spaced apart locations on a curved interior wall of the fourth petal, the transverse arcuate distal wall, the oppositely disposed sidewalls and the curved interior wall having adjoining top ends and adjoining bottom ends, the adjoining top ends surrounding a flat top surface, the adjoining bottom ends surrounding a flat bottom surface, a distance from the flat bottom surface to the flat top surface of the fourth petal being the same as the distance from the flat bottom surface of the central body to the circumferential top edge of the central body, a curvature of the curved interior wall of the fourth petal being equal to an exterior curvature of said circumferential end wall of said central body, the interior curved wall of the fourth petal including a fourth petal retaining member, a base of a fourth writing instrument attached to the interior curved wall, the base of the fourth writing instrument retaining a fourth writing instrument tip, the transverse end wall of the central body including a combined fourth writing instrument receiving member and fourth petal retaining member which is an aligned opening extending from the circumferential end wall into an interior of the central body to removably press fit retain the fourth petal and conceal the fourth writing instrument tip;

g. a fifth petal having a transverse arcuate distal wall with oppositely disposed transverse side walls which extend from opposite sides of the transverse arcuate distal wall and end at spaced apart locations on a curved interior wall of the fifth petal, the transverse arcuate distal wall, the oppositely disposed sidewalls and the curved interior wall having adjoining top ends and adjoining bottom ends, the adjoining top ends surrounding a flat top surface, the adjoining bottom ends surrounding a flat bottom surface, a distance from the flat bottom surface to the flat top surface of the fifth petal being the same as the distance from the flat bottom surface of the central body to the circumferential top edge of the central body, a curvature of the curved interior wall of the fifth petal being equal to an exterior curvature of said circumferential end wall of said central body, the interior curved wall of the fifth petal including a fifth petal retaining member, a base of a fifth writing instrument attached to the interior curved wall, the base of the fifth writing instrument retaining a fifth writing instrument tip, the transverse end wall of the central body including a combined fifth writing instrument receiving member and fifth petal retaining member which is an aligned opening extending from the circumferential end wall into an interior of the central body to removably press fit retain the fifth petal and conceal the fifth writing instrument tip; and h. the first petal is a first selected color and the first writing instrument writes in the same first selected color, the second petal is a second selected color and the second writing instrument writes in the same second selected color, the third petal is a third selected color and the third writing instrument writes in the same third selected color, the fourth petal is a fourth selected color and the fourth writing instrument writes in the same fourth selected color and, the fifth petal is a fifth selected color and the fifth writing instrument writes in the same fifth selected color; and i. wherein, a combination of the central body and spaced apart first petal, second petal, third petal, fourth petal and fifth petal provide operation as a spinning top spinning about the top central tip when it is placed on a horizontal surface and a horizontal force is applied to the central body, and a combination of five petals serve to balance the top central tip and prolong the spinning, and when stationary, each of the spaced apart first petal, second petal, third petal, fourth petal and fifth petal function as a writing instrument when a petal is pulled out of the central body with the petal gripped and the writing tip used to write.

11. The apparatus in accordance with claim 10, further comprising each respective selected color is a different color.

12. The apparatus in accordance with claim 10, further comprising each respective selected color is the same color.

13. The apparatus in accordance with claim 10, further comprising: the central body has a round circumferential end wall and the first petal, the second petal the third petal, the fourth petal and the fifth petal are equally spaced apart around the round circumferential end wall of the central body.

14. The apparatus in accordance with claim 10, further comprising each respective writing instrument is selected from the group consisting of a highlighter, a market, a crayon, a pen and a pencil.

15. An apparatus comprising:

a. a central circular body bounded by a circumferential transverse end wall having a first given height which extends from a circumferential edge of the central circular body top surface to a flat bottom surface, the top surface extends from its circumferential edge at an upwardly sloped section terminating in a top central tip;

b. a multiplicity of petals removably retained at spaced apart locations on the circumferential transverse end wall to give a combination of the central circular body and the multiplicity of petals the appearance of a flower, each of the respective multiplicity of petals retaining a writing instrument;

c. each respective one of the multiplicity of petals having a curved transverse interior wall having an interior curvature which is the same as an exterior curvature of said circumferential transverse end wall, each of the multiplicity of petals having a second given height extending from a circumference of a top surface to a bottom surface, the first given height equal to the second given height, the curved transverse interior wall of each respective petal including a petal retaining member and a writing instrument attached to the curved transverse interior wall, the central circular body having a respective petal receiving member to removably retain a respective petal retaining member and conceal the respective writing instrument; and d. a combination of the central circular body and the multiplicity of spaced apart petals provide operation as a spinning top spinning about the top central tip when it is placed on a horizontal surface and a horizontal force is applied to the central circular body, and a combination of the multiplicity of petals serve to balance the top central tip and prolong the spinning, and when stationary, each of the respective multiplicity of petal functioning as a writing instrument when a respective petal is pulled out of the central circular body with the petal gripped and the writing tip used to write.

16. The apparatus in accordance with claim 15, further comprising: each of the multiplicity of petals is a selected color.

17. The apparatus in accordance with claim 15, further comprising: each of the multiplicity of petals retains a writing instrument having a color the same as a color of the petal retaining the writing instrument.

18. The apparatus in accordance with claim 15, further comprising: each of the multiplicity of petals retains a writing instrument having a different color from a color of the petal retaining the writing instrument.

19. The apparatus in accordance with claim 15, further comprising: each of the multiplicity of petals having a different color.

20. The apparatus in accordance with claim 15, further comprising: each of the multiplicity of petals having the same color.

21. The apparatus in accordance with claim 15, further comprising each respective writing instrument is selected from the group consisting of a highlighter, a marker, a crayon, a pen and a pencil.

* * * * *